US005577640A

United States Patent [19]

Albini et al.

[11] Patent Number: 5,577,640

[45] Date of Patent: Nov. 26, 1996

[54] CREAMY SUBSTANCE DISPENSER, IN PARTICULAR FOR TOOTHPASTE

[75] Inventors: Giovanni Albini; Tommaso Ruscitti, both of Milan; Franco Carlappi, Pianello Valtidone, all of Italy

[73] Assignee: TER S.r.l., Milan, Italy

[21] Appl. No.: 401,903

[22] Filed: Mar. 10, 1995

[30] Foreign Application Priority Data

Jun. 1, 1994 [IT] Italy ..... MI94A1139

[51] Int. Cl.[6] ..... B67D 5/42

[52] U.S. Cl. ..... 222/378; 222/380; 222/383.1; 222/387

[58] Field of Search ..... 222/321.8, 378, 222/380, 383.1, 385, 387

[56] References Cited

U.S. PATENT DOCUMENTS

| | | | |
|---|---|---|---|
| 3,478,935 | 11/1969 | Brooks | 222/321.8 |
| 4,323,175 | 4/1982 | Eckert | 222/380 X |
| 4,691,847 | 9/1987 | Ford et al. | 222/383.1 X |
| 4,821,926 | 4/1989 | Battegazzore | 222/380 X |
| 4,890,773 | 1/1990 | Corsette | 222/383.1 X |
| 5,056,690 | 10/1991 | Ichihara et al. | 222/383.1 X |
| 5,176,291 | 1/1993 | Filmore et al. | 222/380 X |
| 5,242,090 | 9/1993 | Reyss | 222/321.8 |

FOREIGN PATENT DOCUMENTS

| | | | |
|---|---|---|---|
| 0376097 | 7/1990 | European Pat. Off. | 222/380 |
| 3713294 | 11/1988 | Germany . | |
| 6466475 | 3/1989 | Japan . | |

*Primary Examiner*—Andres Kashnikow
*Assistant Examiner*—Kenneth Bomberg
*Attorney, Agent, or Firm*—Oblon, Spivak, McClelland, Maier & Neustadt, P.C.

[57] ABSTRACT

A creamy substance dispenser is formed from a small number of components of easy and economical construction and assembly. The dispenser includes a main body defining a metering chamber communicating with a creamy substance container, within the chamber there being sealedly slidable a piston from which is projected a hollow stem extending into a hollow appendix projecting from a skirt rigid with the main body. The appendix is provided with a discharge hole closable by the end of said stem and biased by a spring, the stem freeing said discharge hole when made to translate by manual action.

3 Claims, 2 Drawing Sheets

CREAMY SUBSTANCE DISPENSER, IN PARTICULAR FOR TOOTHPASTE

FIELD OF THE INVENTION

This invention relates to a creamy substance dispenser, in particular for toothpaste, which is of a very simple and economical structure.

1. Discussion of the Background

Many creamy substances are enclosed in containers of elongate cylindrical form closed at one end by a base provided with lips which seal against the inner cylindrical surface of the relative container. This base is movable by the effect of atmospheric pressure, and moves (to reduce the volume of the chamber containing the creamy substance) each time a certain quantity of creamy substance is drawn through a non-return valve into a delivery chamber in which a vacuum has been created. On manually operating the dispenser, the substance is discharged from this chamber to the outside through a discharge hole provided in the dispenser forming part of the container.

Known dispensers have a relatively complex structure and are therefore relatively costly.

2. Summary of the Invention

The main object of the present invention is to provide a creamy substance dispenser-container which is of very low cost by consisting only of a very small number of parts of simple structure and easy assembly, while perfectly sealing the discharge hole to isolate the creamy substance present in the dispenser from the air.

This and further objects are attained by a dispenser comprising a main body defining a chamber fillable with a creamy substance, said chamber housing a movable base which seals against and is freely slidable along the inner cylindrical surface of the chamber which, via a hole closed by a non-return suction valve, communicates with a metering chamber from which the fluid can be expelled to the outside through a discharge hole, characterized in that said metering chamber is partly delimited by a cylindrical tubular wall sealedly housing a slidable piston from which there extends a hollow stem which is closed at its free end and is provided laterally with apertures in proximity to said end, the stem extending into a hollow appendix projecting from a substantially rigid skirt rigid with the main body, in said appendix there being provided a discharge hole which, when the dispenser is in its rest state, is sealed by the free end of the stem on which a compressed spring acts, and from said skirt there projecting a flexible tongue from which there extends at least one fin which acts on said piston to cause it to move axially with consequent withdrawal of the free end of its stem from said discharge hole when said tongue is pressed by a finger.

Preferably, from said hollow stem there projects a flexible annular lip which seals against the cylindrical surface of said skirt appendix, said lip being positioned between the apertures provided in said stem and the piston from which the stem projects.

BRIEF DESCRIPTION OF THE DRAWINGS

The structure and characteristics of the creamy substance dispenser according to the present invention will be more apparent from the description of one embodiment thereof given hereinafter by way of non-limiting example with reference to the accompanying drawings, in which.

Figure 1:
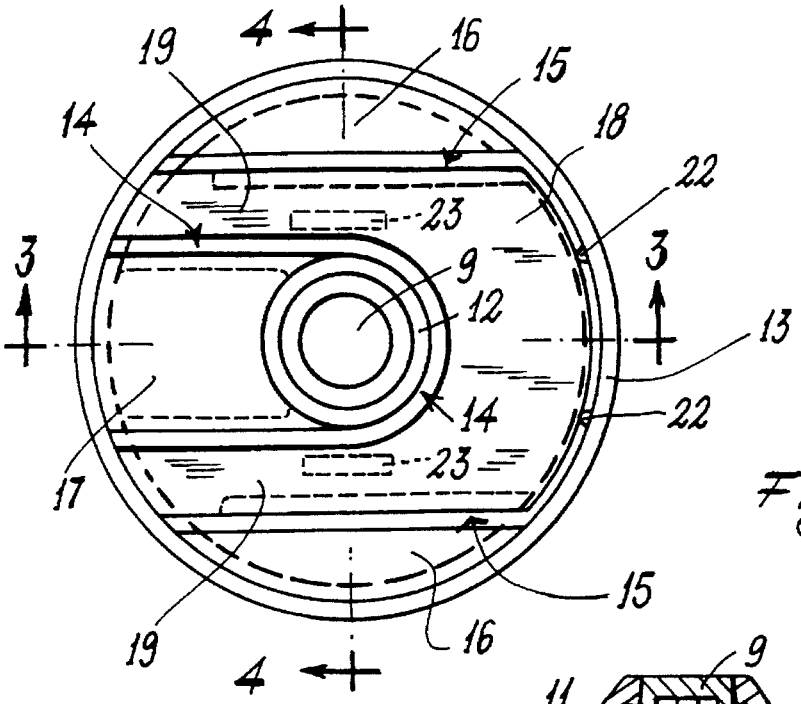
FIG. 1 is a view of the dispenser from above.

The dispenser shown on the drawings comprises a main body 1 defining a cylindrical chamber filled with a creamy substance (for example toothpaste), which is sealed at one end by a slidable base 2 (FIG. 3) and closed at its other end by a flexible diaphragm 3 acting as a non-return valve and covering holes 4 from the center of which there projects a pin 5 which retains the diaphragm 3.

The structure described up to this point is conventional and common to most creamy substance containers-dispensers.

As can be seen from FIGS. 3 and 4, from the top of the body 1 there projects a cylindrical tubular wall 6 defining a metering chamber closed at one end by the diaphragm 3 and at its other end by a slidable piston 7 from which there extends a hollow stem 8 closed at its free end, in proximity to which there are provided apertures 10, immediately below which there is a flexible annular lip 11 projecting from the stem and sealing against the cylindrical surface of the longitudinal cavity of an appendix 12 projecting from a substantially rigid skirt 13 mounted on the upper end (relative to FIGS. 3 and 4) of the body 1.

As can be seen from all figures, the skirt 13 is substantially in the form of a cap partly interrupted by two cuts 14 and 15, which in plan view are substantially of U-shape (FIG. 1). These cuts define within the skirt two lateral portions 16 and a central portion 17, which are substantially rigid so that the hollow appendix 12 also remains substantially rigid and still during the operation of the dispenser.

The intermediate portion 18 of the skirt (intended to act as a tongue on which a finger is rested), ie that portion lying between two cuts 14 and 15, is connected to the rigid portion 13 of the skirt by two strips or levers 19 which are flexible. This flexibility is achieved by the elasticity of the material (plastics) with which the dispenser is constructed.

It should also be noted that the hollow stem 8 is urged upwards by a spring 20 acting against the diaphragm 3, so that when the dispenser is in its rest state (FIGS. 3 and 4), the end 9 of the stem 8 presses and seals against the discharge hole provided at the upper end of the hollow appendix 12. The spring 20 rests against longitudinal ribs 21 projecting into the hollow stem 8.

Finally, it can be seen that the rockable intermediate portion 18 of the skirt is connected to the substantially rigid part 13 of the skirt by a number of breakable teeth 22 (FIGS. 1 and 3) acting as a security seal, and that from each of the two strips 19 there projects a fin 23, the free rounded end of which rests on the upper end of the piston 7.

Figure 3:
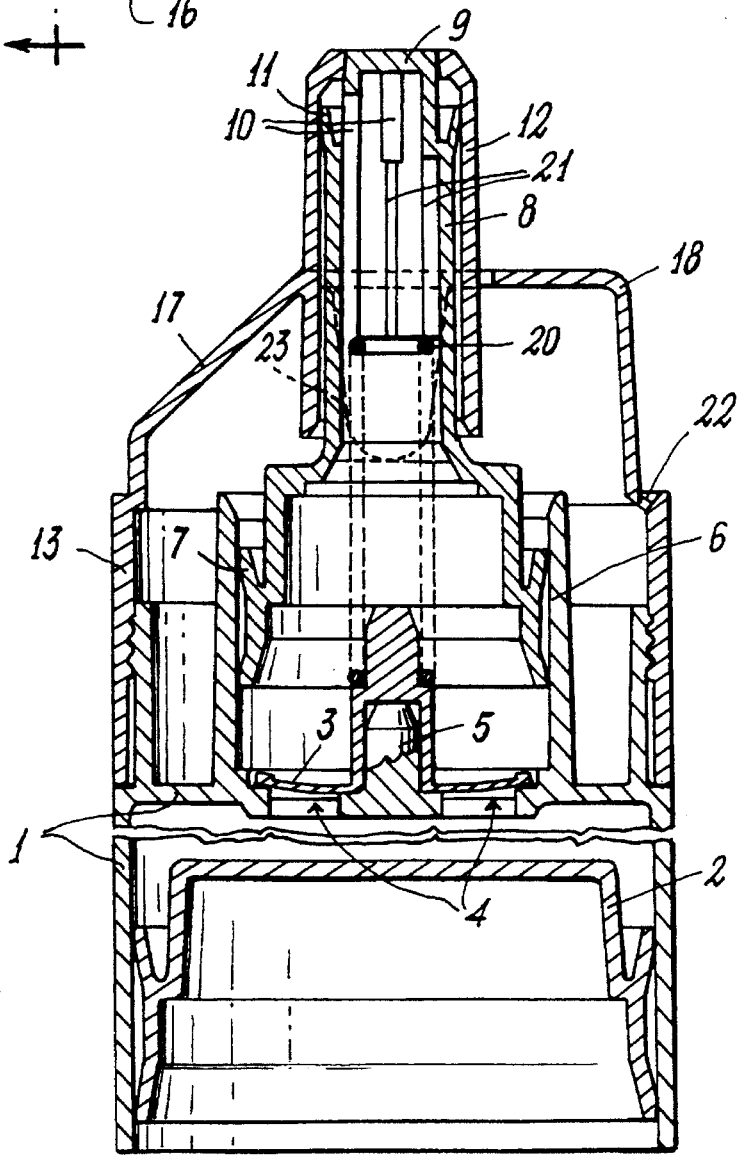
FIGS. 3 and 4 are partial longitudinal sections through the dispenser in its rest state, taken along lines 3—3 and 4—4 of FIG. 1, respectively.
Figure 2:
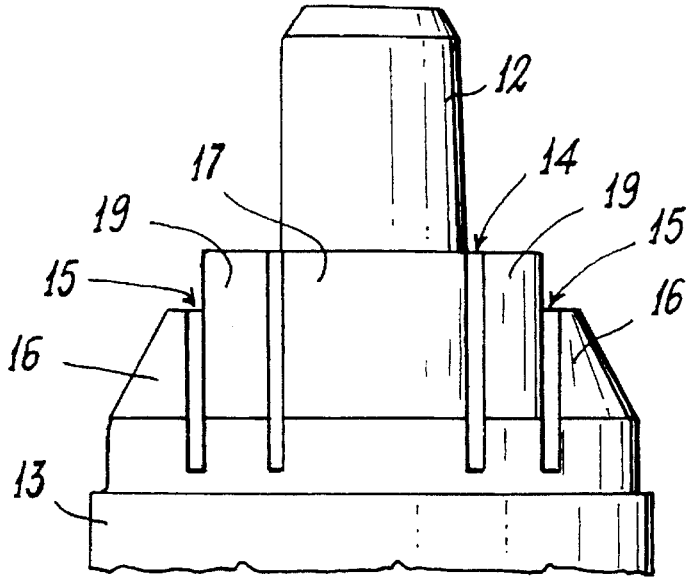
FIG. 2 is a partial side elevation of the dispenser in the direction from left to right in FIG. 1.
Figure 4:
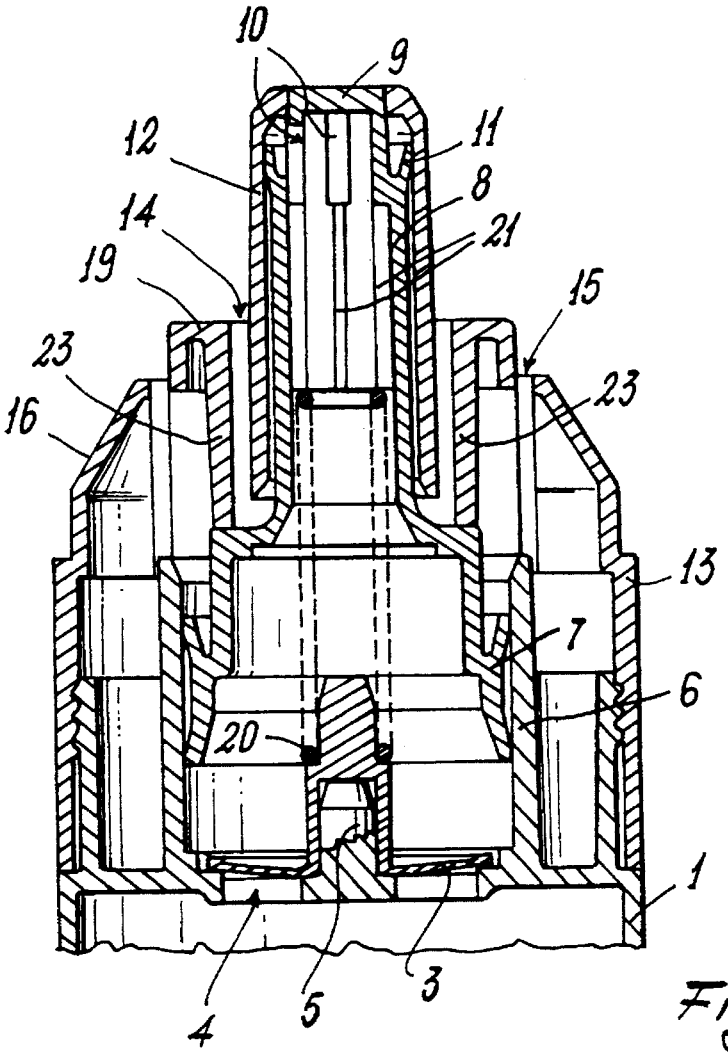

It will be assumed that the rest position shown in FIGS. 3 and 4 applies, and that the chamber defined by the body 1, the metering chamber and the hollow stem 8 above the non-return diaphragm valve 3 are filled with toothpaste.

The tongue 18 is then pushed downwards (relative to FIGS. 3 and 4) with a finger, by which firstly the security teeth 22 are broken (if not already broken) and the two strips 19 are flexed, with lowering of the fins 23 which press against the upper end of the piston 7 to cause it to approach the diaphragm valve 3 (which rests and seals against its seat, so closing the holes 4) and lower the stem 8 within the appendix 12, the discharge hole of which is left free by the end 9 of the stem. The toothpaste urged by the piston is hence expelled to the outside of the dispenser for use, the annular lip 11 preventing the toothpaste seeping downwards.

When the tongue 18 is released, the piston 7 rises under the thrust of the spring 20 to create a vacuum which opens the diaphragm valve 3 and causes the toothpaste to rise through the holes 4. Theoretically, during the filling of the metering chamber, air could be drawn from the outside through the discharge hole and apertures 10. However because of the density of the toothpaste and the small dimensions of the apertures 10, this does not happen because the holes 4 are of much greater area than the apertures 10. On termination of the upward travel of the piston 7, the end 9 of the stem 8 becomes inserted into (and closes in an airtight manner) the discharge hole provided at the top of the hollow appendix 12, so that the toothpaste present in the container-dispenser is completely and perfectly isolated from the outside.

It should be noted that operating the dispenser by the tongue 18 facilitates dispensing, because the tongue 18 and strips 19 act as levers which limit the force required for delivery.

Finally, it should be noted that the described dispenser in its complete state consists only of six component parts, all of simple and economical construction and assembly.

Obviously, numerous modifications and variations of the present invention are possible in light of the above teachings. It is therefore to be understood that within the scope of the appended claims, the invention may be practiced otherwise than as specifically described herein.

We claim:

1. A creamy substance dispenser comprising:

a main body defining a chamber fillable with a creamy substance, said chamber housing a movable base which sealingly contacts and is freely slidable along an inner cylindrical surface of the chamber wherein the main body has a hole formed therein and a non-return suction valve closing said hole, the hole communicating with a metering chamber from which said creamy substance can be expelled;

a slidable piston sealingly housed in the metering chamber;

a hollow stem extending from said piston wherein said stem is closed at a free end thereof and is provided laterally with apertures located in proximity with said end;

a substantially rigid skirt coupled to the main body and projecting from said main body, said hollow stem extending into a hollow appendix of said rigid skirt, and wherein said hollow appendix is provided with a discharge hole through which the creamy substance is expellable, discharge hole of said hollow appendix, said discharge hole of said hollow appendix being sealed by said closed free end of said hollow stem, when the dispenser is in a rest state;

a compressed spring which acts against the free end of the stem;

a manually tiltable lever projecting from the skirt and having at least one fin which is engageable with said piston so as to move the piston axially wherein the stem is withdrawn from said discharge hole when said lever is pressed;

wherein said metering chamber is laterally formed by an open-end cylindrical tubular wall forward of, and made in one piece with the main body and extending therefrom, said piston comprises one piece with said hollow stem, and said lever comprises a tongue formed of one piece with said skirt and wherein said tongue extends from said skirt.

2. A dispenser according to claim 1, wherein said nonreturn valve comprises a disc-shaped valve having a center portion supported by a pin projecting from said main body into said metering chamber and wherein a peripheral portion of said valve overlaps an edge of said main body hole.

3. A dispenser according to claim 2, wherein the spring is compressible against the center portion of said disc-shaped valve and against said piston hollow stem.

* * * * *